US011681243B2

(12) United States Patent
Amann et al.

(10) Patent No.: US 11,681,243 B2
(45) Date of Patent: Jun. 20, 2023

(54) SEALING ASSEMBLY FOR AN ELECTROPHOTOGRAPHIC IMAGE FORMING DEVICE

(71) Applicant: LEXMARK INTERNATIONAL, INC., Lexington, KY (US)

(72) Inventors: Mark William Amann, Lexington, KY (US); Richard Louis Goin, Lexington, KY (US); Randal Scott Williamson, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 17/203,111

(22) Filed: Mar. 16, 2021

(65) Prior Publication Data

US 2021/0200122 A1 Jul. 1, 2021

Related U.S. Application Data

(62) Division of application No. 16/400,175, filed on May 1, 2019, now Pat. No. 10,983,457.

(51) Int. Cl.
*G03G 21/18* (2006.01)
*G03G 15/08* (2006.01)

(52) U.S. Cl.
CPC ..... *G03G 15/0898* (2013.01); *G03G 21/181* (2013.01); *G03G 21/1814* (2013.01); *G03G 21/1832* (2013.01)

(58) Field of Classification Search
CPC ..... G03G 15/0898; G03G 21/181; G03G 21/1814; G03G 21/1832
USPC ..... 399/103
See application file for complete search history.

(56) References Cited

U.S. PATENT DOCUMENTS 7,359,662 B2 * 4/2008 Yamada ..... G03G 15/0812 399/284
11,003,120 B2 * 5/2021 Tojo et al. ..... G03G 15/2092

* cited by examiner

*Primary Examiner* — Arlene Heredia

(57) ABSTRACT

A sealing assembly according to one example embodiment includes a housing and an imaging component positioned on the housing. A seal has opposed first and second edges extending along a longitudinal dimension of the seal. A lateral dimension of the seal is perpendicular to the longitudinal dimension and extends in a direction from the first edge to the second edge. The seal is attached to the housing along the first edge and contacts the imaging component along the second edge. Upon attachment to the housing, the seal is elastically deformed from an unassembled state in which the second edge has a first profile that varies in the lateral dimension along the longitudinal dimension to an assembled state in which the second edge is deformed relative to the first profile to a second profile having less variation in the lateral dimension along the longitudinal dimension than the first profile.

8 Claims, 7 Drawing Sheets

SEALING ASSEMBLY FOR AN ELECTROPHOTOGRAPHIC IMAGE FORMING DEVICE

CROSS REFERENCES TO RELATED APPLICATIONS

This application is a divisional application of U.S. patent application Ser. No. 16/400,175, filed May 1, 2019, entitled "Sealing Assembly for an Electrophotographic Image Forming Device."

BACKGROUND

1. Field of the Disclosure

The present disclosure relates generally to image forming devices and more particularly to a sealing assembly for an electrophotographic image forming device.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles from a developer roll are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The image forming device's toner supply is typically stored in one or more replaceable units, such as a toner cartridge, which may include one or more components for handling toner. For example, in some toner cartridge assemblies, a rotating component positioned adjacent to a housing of the toner cartridge may form part of an enclosure that confines toner within the toner cartridge. One or more seals are typically positioned along any gaps between the rotating component and the housing in order to prevent toner leakage. It is important for the seal to only contact components and surfaces it is intended to. Otherwise, seal performance may be compromised and toner leakage may occur if the seal touches a neighboring component, especially a moving component, since a moving component may cause the seal to deform and create gaps or spaces for toner to pass through. Further, as toner cartridges are designed to be smaller, the sizes of toner cartridge components are decreased and/or components are positioned closer to each other in order to achieve a compact toner cartridge design. In toner cartridges with relatively small form factor designs, even tighter seal dimensional tolerances and assembly techniques may be required to assemble the seals as the gaps between components become smaller. Accordingly, a sealing assembly that achieves efficient seal performance is desired.

SUMMARY

A sealing assembly for use in an electrophotographic image forming device according to one example embodiment includes a housing and an imaging component positioned on the housing. A seal has opposed first and second edges extending along a longitudinal dimension of the seal. A lateral dimension of the seal is perpendicular to the longitudinal dimension and extends in a direction from the first edge to the second edge. The seal is attached to the housing along the first edge and contacts the imaging component along the second edge. Upon attachment to the housing, the seal is elastically deformed from an unassembled state in which the second edge has a first profile that varies in the lateral dimension along the longitudinal dimension to an assembled state in which the second edge is deformed relative to the first profile to a second profile having less variation in the lateral dimension along the longitudinal dimension than the first profile.

Embodiments include those wherein in the unassembled state of the seal, the second edge of the seal tapers toward the first edge from first and second end portions of the second edge toward a central portion of the second edge. In some embodiments, in the unassembled state of the seal, the second edge of the seal tapers linearly toward the first edge from the first and second end portions of the second edge toward the central portion of the second edge. In some embodiments, in the unassembled state of the seal, the second edge of the seal curves toward the first edge from the first and second end portions of the second edge toward the central portion of the second edge.

Embodiments include those wherein in the assembled state of the seal, the second edge of the seal extends uniformly in the lateral dimension along the longitudinal dimension.

Embodiments include those wherein in the unassembled state of the seal, the first edge of the seal extends uniformly in the lateral dimension along the longitudinal dimension. Embodiments also include those wherein in the unassembled state of the seal, the first edge of the seal varies in the lateral dimension along the longitudinal dimension.

In some embodiments, the first edge of the seal includes a notch formed at a middle section of the first edge for receiving a reference datum during assembly of the seal onto the housing.

A sealing assembly for use in an electrophotographic image forming device according to another example embodiment includes a housing and an imaging component positioned on the housing. A seal has opposed first and second edges extending along a longitudinal dimension of the seal. The seal is attached to an attachment section of the housing along the first edge. The second edge extends in a cantilevered manner away from the attachment section of the housing. The seal contacts the imaging component along the second edge. First and second end portions of the second edge are positioned proximate first and second longitudinal ends of the seal. Upon attachment of the seal to the housing, the seal is elastically deformed from an unassembled state to an assembled state in which a central portion of the second edge extends further relative to the first and second end portions of the second edge in a direction from the first edge toward the second edge in comparison with the unassembled state of the seal.

A sealing assembly for use in an electrophotographic image forming device according to another example embodiment includes a housing and an imaging component positioned on the housing. A seal has opposed first and second edges extending along a longitudinal dimension of the seal. A lateral dimension of the seal is perpendicular to the longitudinal dimension and extends in a direction from the first edge to the second edge. The seal is attached to the housing along the first edge and contacts the imaging component along the second edge. Upon attachment to the housing, the seal is elastically deformed from an unassembled state in which the first edge has a first profile that varies in the lateral dimension along the longitudinal dimension to an assembled state in which the first edge is deformed relative to the first profile to a second profile having less variation in the lateral dimension along the longitudinal dimension than the first profile.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
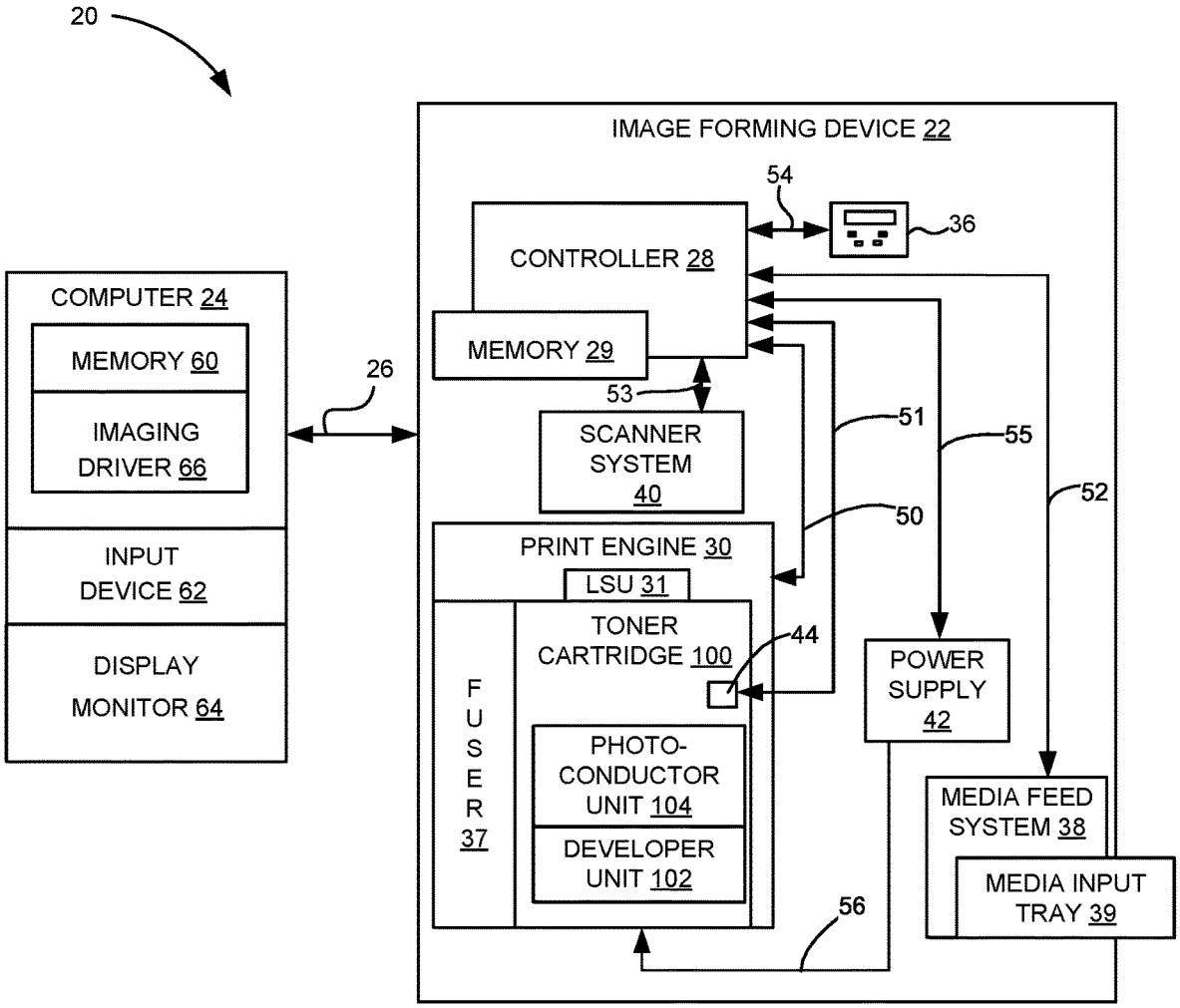
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24, Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, a toner cartridge 100, a user interface 36, a media feed system 38, a media input tray 39, a scanner system 40 and a power supply 42. Image forming device 22 may communicate with computer 24 via a standard communication protocol, such as, for example, universal serial bus (USW), Ethernet or IEEE 802.xx. Image forming device 22 may be, for example, an electrophotographic printer/copier including an integrated scanner system 40 or a standalone el electrophotographic printer.

Controller 28 includes a processor unit and associated memory 29. The processor unit may include one or more integrated circuits in the form of a microprocessor or central processing unit and may be formed as one or more Application-Specific Integrated Circuits (ASICs). Memory 29 may be any volatile or non-volatile memory or combination thereof such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with toner cartridge 100 and processing circuitry 44 thereon via a communications link 51. Controller 28 communicates with media feed system 38 via a communications link 52. Controller 28 communicates with scanner system 40 via a communications link 53. User interface 36 is communicatively coupled to controller 28 via a communications link 54. Controller 28 communicates with power supply 42 via a communications link 55. Controller 28 processes print and scan data and operates print engine 30 during printing and scanner system 40 during scanning. Processing circuitry 44 may provide authentication functions, safety and operational interlocks, operating parameters and usage information related to toner cartridge 100. Processing circuitry 44 includes a processor unit and associated electronic memory. As discussed above, the processor may include one or more integrated circuits in the form of a microprocessor or central processing unit and/or may to include one or more Application-Specific Integrated Circuits (ASICs). The memory may be any volatile or non-volatile memory or combination thereof or any memory device convenient for use with processing circuitry 44.

Computer 24, which is optional, may be, for example, a personal computer, including memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100 and a fuser 37, all mounted within image forming device 22. Toner cartridge 100 is removably, mounted in image forming device 22. Power supply 42 provides an electrical voltage to various components of toner cartridge 100 via an electrical path 56. Toner cartridge 100 includes a developer unit 102 that houses a toner reservoir and a toner development system. In one embodiment, the toner development system utilizes what is commonly referred to as a single to component development system. In this embodiment, the toner development system includes a toner adder roll that provides toner from the toner reservoir to a developer roll. A doctor blade provides a metered uniform layer of toner on the surface of the developer roll. In another embodiment, the toner development system utilizes what is commonly referred to as a dual component development system. In this embodiment, toner in the toner reservoir of developer unit 102 is mixed with magnetic carrier beads. The magnetic carrier beads may be coated with a polymeric film to provide triboelectric properties to attract toner to the carrier beads as the toner and the magnetic carrier beads are mixed in the toner reservoir. In this embodiment, developer unit 102 includes a developer roll that attracts the magnetic carrier beads having toner thereon to the developer roll through the use of magnetic fields. Toner cartridge 100 also includes a photoconductor unit 104 that houses a charge roll, a photoconductive drum and a waste toner removal system. Although the example image forming device 22 illustrated in FIG. 1 includes one toner cartridge, in the case of an image forming device configured to print in color, separate toner cartridges may be used for each toner color. For example, in one embodiment, the image forming device includes four toner cartridges, each toner cartridge containing a particular toner color (e.g., black, cyan, yellow and magenta) to permit color printing.

Figure 2:
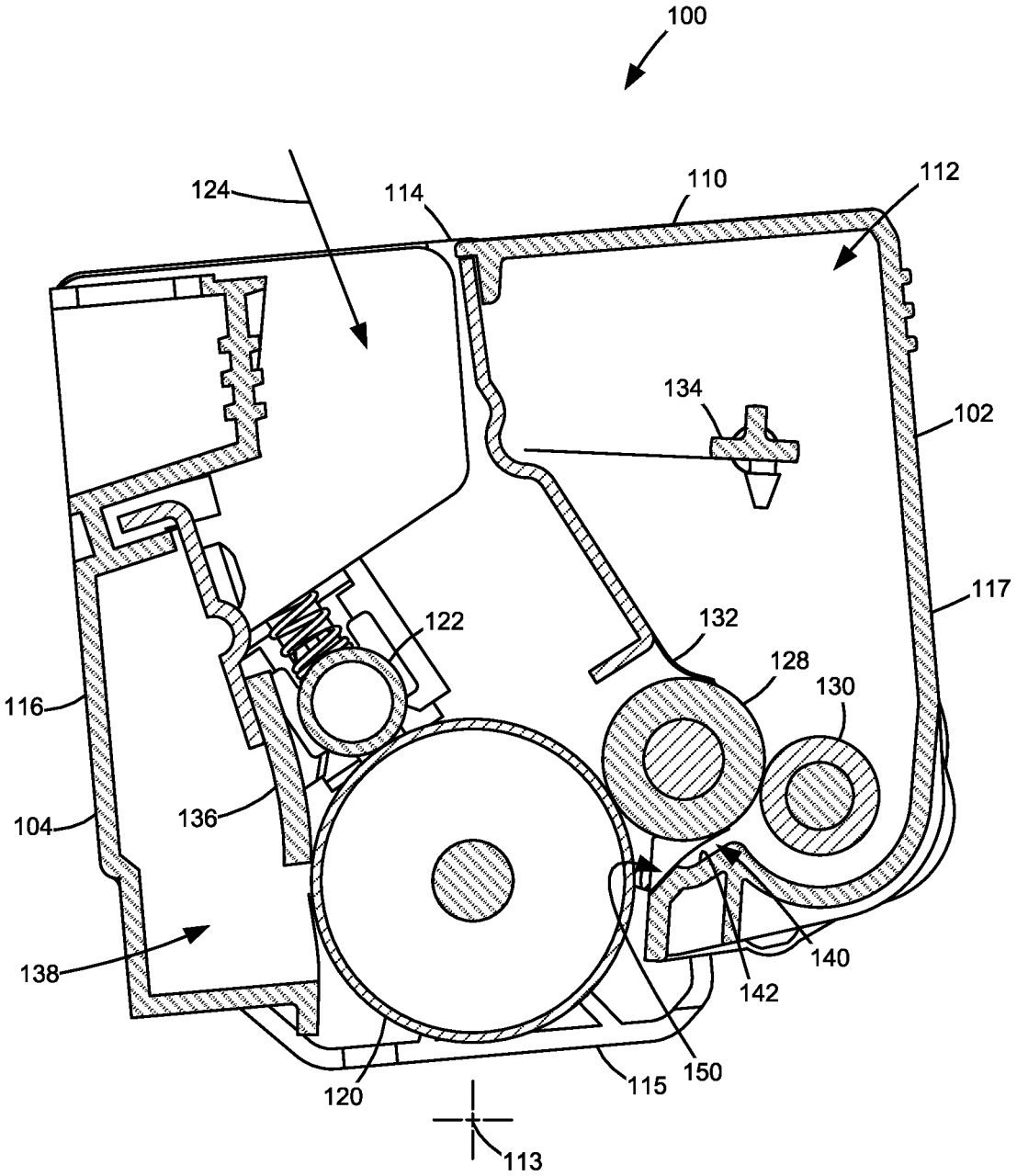
FIG. 2 is a cross-sectional view of a toner cartridge of the imaging system according to one example embodiment.

FIG. 2 shows toner cartridge 100 according to one example embodiment. Toner cartridge 100 includes an elongated housing 110 that includes walls forming a toner reservoir 112. In the example embodiment illustrated, housing 110 extends along a longitudinal dimension 113 and includes a top 114, a bottom 115, a side 116 and a side 117 that extend between longitudinal ends of housing 110. In this embodiment, developer unit 102 is positioned along side 117 of housing 110 and photoconductor unit 104 is positioned along side 116 of housing 110.

The electrophotographic printing process is well known in the art and, therefore, is described briefly herein. During a printing operation, a rotatable charge roll 122 of photoconductor unit 104 charges the surface of a rotatable photoconductive drum 120. The charged surface of photoconductive drum 120 is then selectively exposed to a laser light source 124 from LSU 31 through a slit (not shown) in the top 114 of housing 110 to form an electrostatic latent image on photoconductive drum 120 corresponding to the image to be printed. Charged toner from developer unit 102 is picked up by the latent image on photoconductive drum 120 creating a toned image on the surface of photoconductive drum 120. Charge roll 22 and photoconductive drum 120 are each electrically charged to a respective predetermined voltage by power supply 42 in order to achieve a desired voltage differential between the charged portions of the surface of photoconductive drum 120 and the portions of the surface of photoconductive drum 120 discharged by laser light source 124.

Developer unit 102 includes toner reservoir 112 having toner stored therein and a rotatable developer roll 128 that supplies toner from toner reservoir 112 to photoconductive drum 120. In the example embodiment illustrated, a rotatable toner adder roll 130 in developer unit 102 supplies toner from toner reservoir 112 to developer roll 128. A doctor blade 132 disposed along developer roll 128 provides a substantially uniform layer of toner on developer roll 128 for transfer to photoconductive drum 120. In the example embodiment illustrated, a sealing assembly 150 is positioned adjacent to developer roll 128 to prevent toner from exiting toner reservoir 112 through a gap or space 140 between developer roll 128 and an inner surface 142 of housing 110 near bottom 115.

As developer roll 128 and photoconductive drum 120 rotate, toner particles are electrostatically transferred from developer roll 128 to the latent image on photoconductive drum 120 forming a toned image on the surface of photoconductive drum 120. In one embodiment, developer roll 128 and photoconductive drum 120 rotate in opposite rotational directions such that their adjacent surfaces move in the same direction to facilitate the transfer of toner from developer roll 128 to photoconductive drum 120. One or more movable toner agitators 134 may be provided in toner reservoir 112 to distribute the toner therein and to break up any clumped toner. Developer roll 128 and toner adder roll 130 are each electrically charged to a respective predetermined voltage by power supply 42 in order to attract toner from reservoir 112 to toner adder roll 130 and to electrostatically transfer toner from toner adder roll 130 to developer roll 128 and from developer roll 128 to the latent image on the surface of photoconductive drum 120. Doctor blade 132 may also be electrically charged to a predetermined voltage by power supply 42 as desired.

The toned image is then transferred from photoconductive drum 120 to the print media (e.g., paper) either directly by photoconductive drum 120 or indirectly by an intermediate transfer member. In the example embodiment illustrated, the surface of photoconductive drum 120 is exposed from housing 110 along the bottom 115 of housing 110 where the toned image transfers from photoconductive drum 120 to the print media or intermediate transfer member. Fuser 37 (FIG. 1) then fuses the toner to the print media. A cleaner blade 136 (or cleaner roll) of photoconductor unit 104 removes any residual toner adhering to photoconductive drum 120 after the toner is transferred from photoconductive drum 120 to the print media or intermediate transfer member, Waste toner from cleaner blade 136 may be held in a waste toner reservoir 138 in photoconductor unit 104 as illustrated or moved to a separate waste toner container. The cleaned surface of photoconductive drum 120 is then ready to be charged again and exposed to laser light source 124 to continue the printing cycle.

Figure 3:
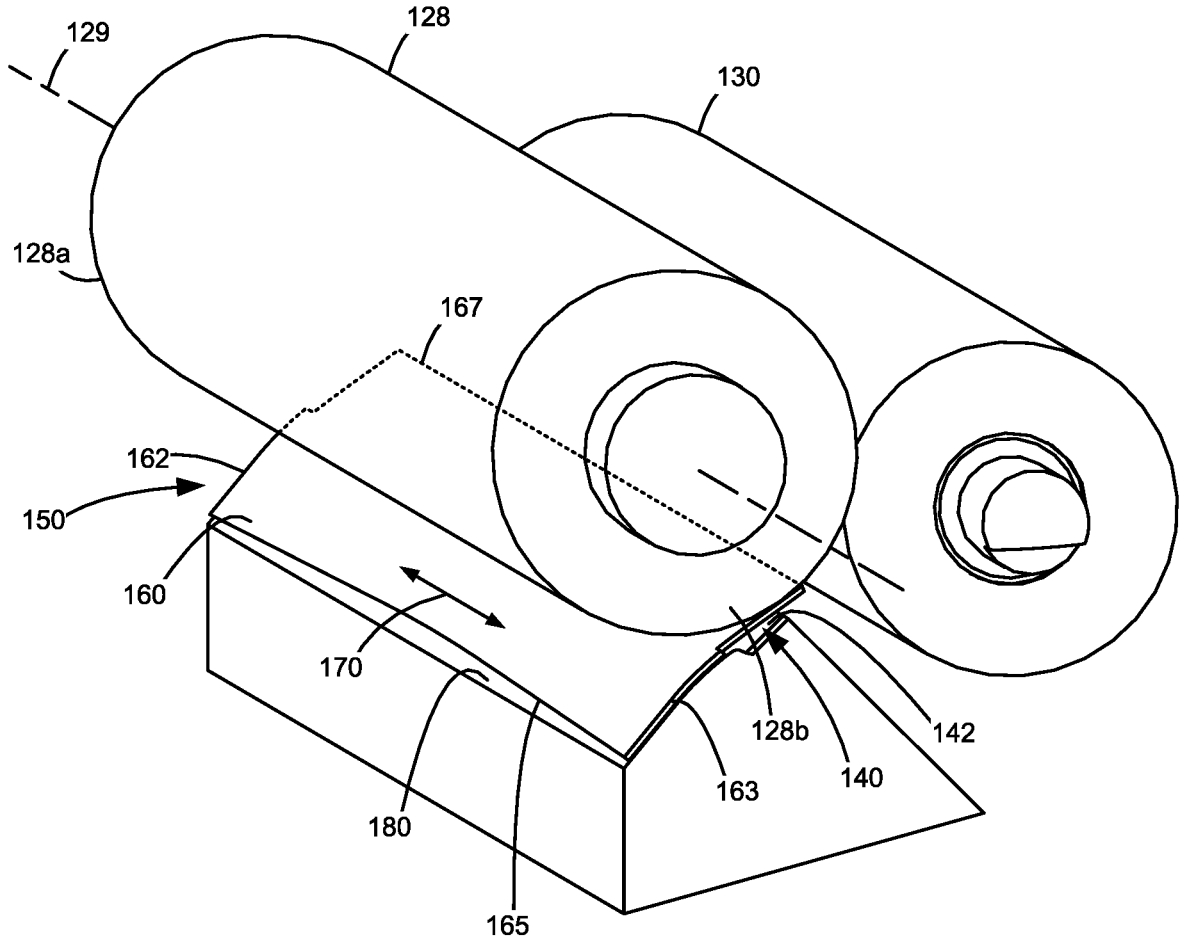
FIG. 3 is a perspective view of a sealing assembly relative to a developer roll to and a toner adder roll of the toner cartridge according to one example embodiment.

With reference to FIG. 3, a perspective view of sealing assembly 150 relative to developer roll 128 and toner adder roll 130 is illustrated according to one example embodiment. Sealing assembly 150 is positioned adjacent to developer roll 128 in order to seal gap 140 and prevent toner in toner reservoir 112 from exiting toner cartridge 100 through gap 140. Sealing assembly 150 includes a seal 160 extending from a first end 128*a* to a second end 128*b* of developer roll 128. Seal 160 has opposed first and second longitudinal ends 162, 163 and opposed first and second edges 165, 167 extending along a longitudinal dimension 170 of seal 160 between ends 162, 163 thereof. In one embodiment, longitudinal dimension 170 extends substantially parallel to a rotational axis 129 of developer roll 128 when seal 160 and developer roll 128 are assembled onto toner cartridge 100. Longitudinal dimension 170 of seal 160 may also be parallel to longitudinal dimension 113 of housing 110 when seal 160 is mounted on toner cartridge 100. A portion of seal 160 along edge 165 is attached (e.g., adhered) to an attachment surface 180 on inner surface 142 of housing 110. Edge 167 extends in a cantilevered manner from attachment surface 180 of housing 110. In this manner, edge 167 of seal 160 may also be referred to as a free edge 167. Seal 160 contacts the outer surface of developer roll 128 along free edge 167 when seal 160 and developer roll 128 are assembled onto toner cartridge 100. The contact of seal 160 against the outer surface of developer roll 128 prevents toner leakage along gap 140 between developer roll 128 and inner surface 142 of housing 110. Seal 160 may be composed of any suitable flexible material, such as a polyethylene terephthalate (PET) material, e.g., MYLAR®.

Figure 4A:
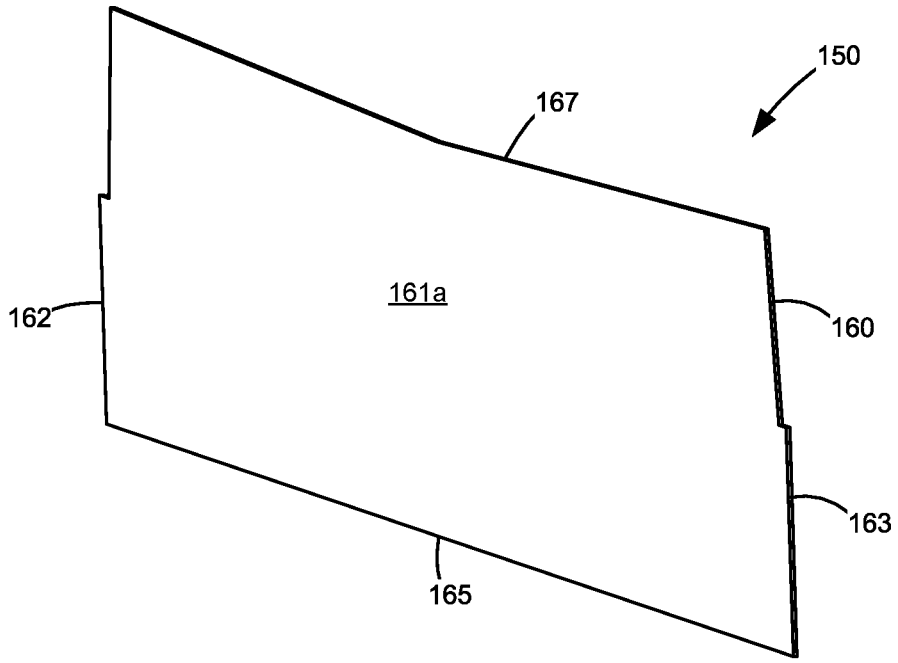
FIGS. 4A and 4B are perspective views of a seal of the sealing assembly in an unassembled state according to one example embodiment.
Figure 4B:
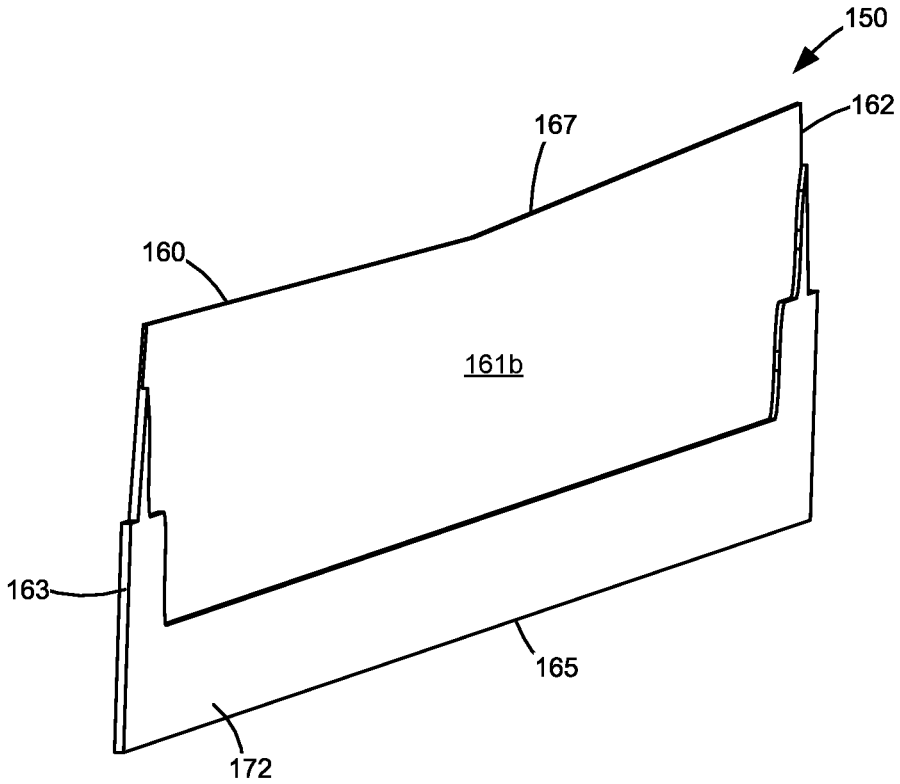

FIGS. 4A and 4B show an example shape and profile of seal 160 prior to assembly onto toner cartridge 100 according to one example embodiment. Accordingly, FIGS. 4A and 4B illustrate an original and/or unassembled state or shape of seal 160. FIG. 4A illustrates a front perspective view of seal 160 while FIG. 4B illustrates a rear perspective view thereof. Seal 160 includes a front surface 161*a* and a rear surface 161*b*. Rear surface 161*b* faces inner surface 142 of housing 110 and includes the portion of seal 160 along edge 165 that attaches to attachment surface 180 of housing 110. Front surface 161*a* faces away from attachment surface 180 of housing 110 and toward developer roll 128 and includes a portion of seal 160 along free edge 167 that contacts developer roll 128. In the example embodiment illustrated, front surface 161*a* and rear surface 161*b* are each substantially planar. However, front and rear surfaces 161*a*, 161*b* may have other forms and/or shapes in other embodiments. In FIG. 4B, rear surface 161*b* is shown having a lower portion and end portions with an adhesive 172 thereon for adhering seal 160 to attachment surface 180. In one example form, adhesive 172 may be a double-sided adhesive with one side attached to rear surface 161*b* of seal 160 and the other side adhered to attachment surface 180 to mount seal 160 on housing 110 of toner cartridge 100.

Figure 5:
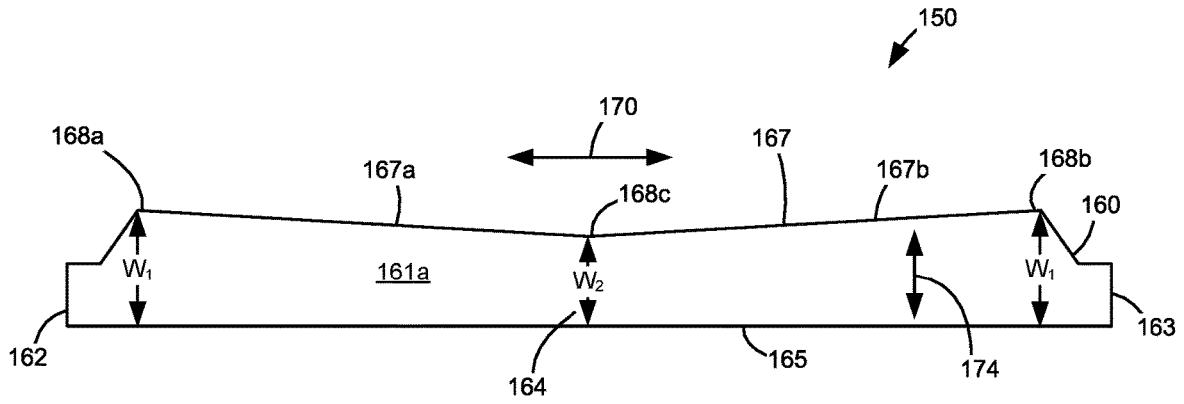
FIG. 5 is a front elevation view of the seal of FIGS. 4A and 4B in the unassembled state.

In one example embodiment, free edge 167 of seal 160 varies and/or has an uneven profile along longitudinal dimension 170 prior to seal 160 being assembled onto toner cartridge 100. For example, FIG. 5 illustrates a front view of seal 160. An extension of free edge 167 in a lateral dimension 174 of seal 160 that is perpendicular to longitudinal dimension 170 varies along longitudinal dimension 170 of seal 160 between end 162 and end 163. Edge 165, on the other hand, extends substantially uniformly in lateral dimension 174 along longitudinal dimension 170 in the embodiment illustrated. Accordingly, in this embodiment, a width W of seal 160 in lateral dimension 174 between edge 165 and edge 167 decreases from ends 162, 163 toward a central portion 164 of seal 160 as free edge 167 tapers inward, toward edge 165. In this embodiment, seal 160 has a width W at or near ends 162, 163 that is greater than a width $W_2$ at or near central portion 164. As viewed in FIG. 5, the width of seal 160 varies in a linear fashion with free edge 167 having two sloped linear segments 167*a*, 167*b* having respective elevated sections 168*a*, 168*b* at or near ends 162, 163, and a common lowered section 168*c* contiguous at central portion 164 of seal 160. However, it will be appreciated that free edge 167 and edge 165 may have other forms and/or shapes and that the change in width of seal 160 along its length may be varied in other fashions as will be described below. In one embodiment, the difference between widths $W_1$ and $W_2$ may correspond to a desired amount of crown to be applied to seal 160 upon assembly onto toner cartridge 100, such as between about 0.5 mm and about 1.0 mm.

In one example embodiment, sealing assembly 150 is arranged such that the stiffness of free edge 167 of seal 160 is increased when seal 160 is assembled onto toner cartridge 100. For example, seal 160 is adhered to attachment surface 180 in a manner that increases the tension along free edge 167 to prevent wrinkling and/or rippling of free edge 167 and to improve seal performance along the interface between free edge 167 of seal 160 and the outer surface of developer roll 128, In one embodiment, increasing the tension along free edge 167 of seal 160 is achieved by applying a crown to seal 160 upon assembly of seal 160 onto toner cartridge 100. The crown may be applied by bending ends 162, 163 away from free edge 167 of seal 160 in a manner that stretches central portion 164 of free edge 167 upon adhering edge 165 of seal 160 to attachment surface 180. In one embodiment, the crown is applied to seal 160 such that a desired amount of tension along free edge 167 is achieved without extending any portion of free edge 167 to a degree that would cause free edge 167 to contact and interfere with neighboring components of toner cartridge 100 other than developer roll 128. For example, if free edge 167 of seal 160 contacts toner adder roll 130, toner adder roll 130 may pull free edge 167 of seal 160 away from developer roll 128 when toner adder roll 130 rotates, which, in turn, may compromise seal performance and cause toner leakage to occur. Accordingly, seal 160 is assembled onto toner cartridge 100 while keeping free edge 167 of seal 160 free from contact with toner adder roll 130 as can be seen, for example, in FIG. 2.

Figure 6:
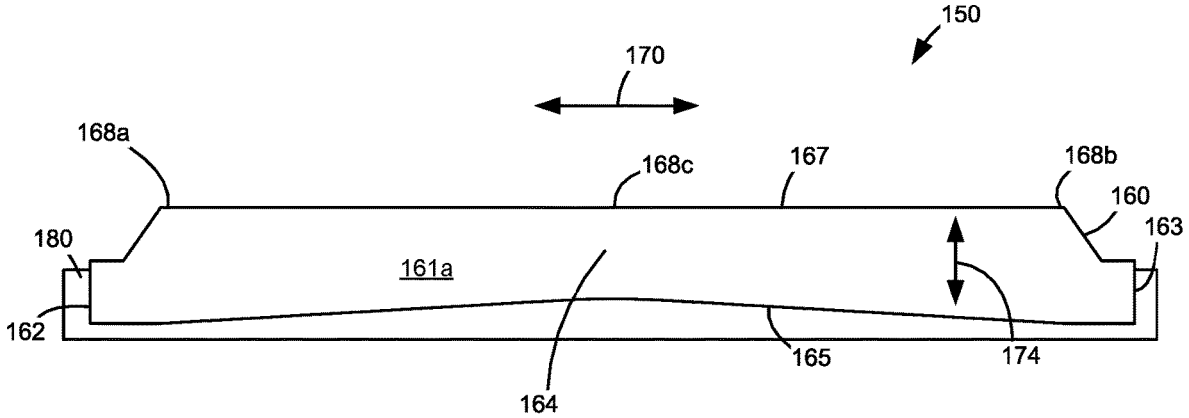
FIG. 6 is a front elevation view of the seal of FIGS. 4A, 4B and 5 in an assembled state.

With reference to FIG. 6, seal 160 is shown in an assembled state relative to attachment surface 180 of housing 110 with a crown applied. In the embodiment shown, when seal 160 is adhered to attachment surface 180, seal 160 elastically deforms from its unassembled shape shown in FIG. 5 in which free edge 167 has an uneven profile along longitudinal dimension 170 to an assembled shape shown in FIG. 6 in which the uneven profile of free edge 167 is substantially reduced. In particular, seal 160 is bent or bowed at ends 162, 163 toward edge 165 such that free edge 167 is stretched to increase the tension and stiffness along free edge 167. As viewed in FIG. 6, for example, seal 160 is elastically deformed such that variation between sections 168*a*, 168*b*, and 168*c* of free edge 167 along longitudinal dimension 170 is reduced. Since free edge 167 initially has an uneven profile prior to seal 160 being assembled onto toner cartridge 100, in this embodiment, increasing the tension along free edge 167 by bending seal 160 in this manner results in free edge 167 having a substantially even profile along longitudinal dimension 170 after assembly onto toner cartridge 100. On the other hand, since edge 165 initially has a substantially even profile prior to seal 160 being assembled onto toner cartridge 100, bending seal 160 in this manner results in edge 165 deforming to follow a substantially uneven profile along longitudinal dimension 170 after assembly of seal 160 onto toner cartridge 100.

With free edge 167 having a substantially even profile along longitudinal dimension 170, contact between any portion of free edge 167 and toner adder roll 130 may be prevented. In this example embodiment, seal 160 is illustrated as being bent to an amount that results in free edge 167 extending substantially uniformly along longitudinal dimension 170. However, in some embodiments, seal 160 may be bent to any desired amount when assembled onto toner cartridge 100 as long as the amount of variation of free edge 167 along longitudinal dimension 170 is reduced so as to prevent any portion of free edge 167 from contacting toner adder roll 130 or other neighboring components.

The uneven profile of free edge 167 is selected to provide an amount of offset between section 168*c* of free edge 167 at central portion 164 and end sections 168*a*, 168*b* at opposed ends 162, 163 that allows free edge 167 to exhibit a desired amount of stiffness when seal 160 is applied with a crown upon assembly onto toner cartridge 100 while keeping free edge 167 free from contact with toner adder roll 130. The amount of offset may be set or predetermined based on certain requirements of toner cartridge operation, such as the temperature range of operation and/or the desired maximum movement of seal 160. For example, the amount of offset may be selected depending on the material properties of sealing assembly 150 such as the coefficient of thermal expansion and thermal conductivity of seal 160, adhesive 172, and/or attachment surface ISO, and the response across various environmental and/or toner cartridge conditions, such as changes in temperature and humidity, vibration and shock. These and other measurements and/or parameters may be obtained empirically by testing and measuring the use of seal assembly 150 in toner cartridge 100.

As mentioned above, seal 160 may take other forms and/or shapes in the unassembled and/or assembled state. For example, with reference to FIG. 7, a seal 260 according to another example embodiment is illustrated in an unassembled state. Seal 260 has an edge 265 and a free edge 267 extending between opposed first and second longitudinal ends 262, 263 along a longitudinal dimension 170. In the example embodiment illustrated, free edge 267 includes a parabolic or curved profile that varies along longitudinal dimension 170 prior to assembly of seal 260 onto toner cartridge 100. More particularly, seal 260 is shown having an unassembled state in which free edge 267 curves concavely inward toward edge 265 that is attachable to attachment surface 180 when seal 260 is assembled onto toner cartridge 100. Accordingly, free edge 267 varies along longitudinal dimension 170 with a middle section 268*c* of free edge 267 being offset by a predetermined amount relative to end sections 268*a*, 268*b* of free edge 267. When seal 260 is adhered to attachment surface 180, seal 260 is applied with a crown such that the variation between middle section 268*c* and end sections 268*a*, 268*b* of free edge 267 is reduced along longitudinal dimension 170, as illustrated in FIG. 8. In the example shown, free edge 267 extends with a substantially even profile along longitudinal dimension 170 after seal 260 is adhered to attachment surface 180.

Figure 7:
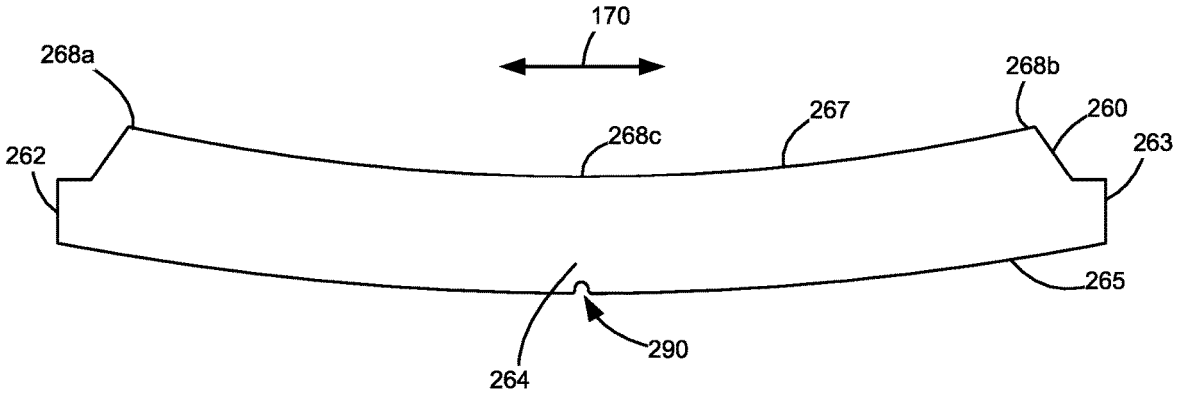
FIG. 7 is a front elevation view of a seal in an unassembled state according to another example embodiment.
Figure 8:
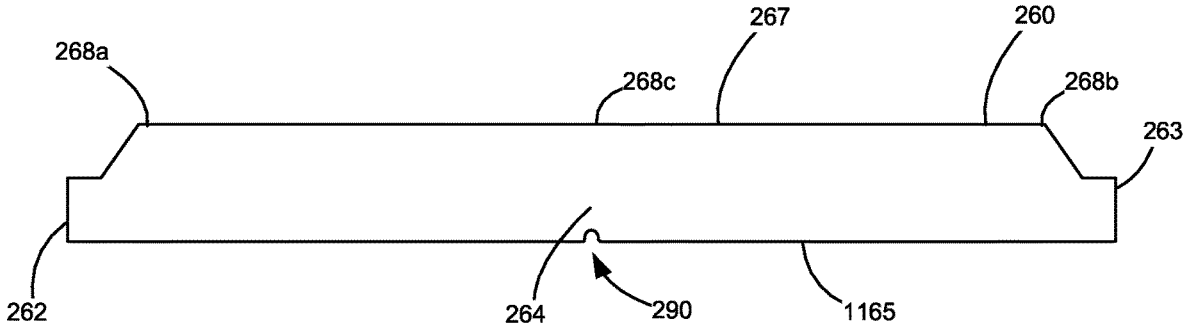
FIG. 8 is a front elevation view of the seal of FIG. 7 in an assembled state.

With further reference to FIG. 7, edge 265 also has a parabolic and/or curved profile prior to assembly onto toner cartridge 100. In the example embodiment illustrated in FIG. 7, edge 265 is shown following the curvature of free edge 267, curving convexly outward away from free edge 267. It is noted, however, that edge 265 may have a profile that is different from the profile of free edge 267 in other embodiments. When a crown is applied to seal 260 upon adhering seal 260 to attachment surface 180, the variation along edge 265 is reduced such that edge 265 extends substantially uniformly along longitudinal dimension 170, as illustrated in FIG. 8.

In one example embodiment, seal 260 is adhered to attachment surface 180 using assembly line fixtures during production. For example, seal 260 may be placed on an assembly fixture having alignment surfaces that locate seal 260 near or at its desired assembled state and/or position. At about the middle of edge 265, a notch 290 is provided which aligns with a reference datum on the fixture that positions a central portion 264 of seal 260 at a location where the maximum crown or bend for seal 260 is desired. This allows for more accurate positioning of seal 260. In addition, the use of notch 290 may prevent poor attachment of seal 260 onto attachment surface 180. In particular, when seal 260 is applied with a crown as described above, edge 265 may protrude from and not properly attach to attachment surface 180 at central portion 264 of seal 260 due to the maximum amount of bend occurring at central portion 264 of seal 260. By providing notch 290 at about the middle of edge 265, a more effective attachment of seal 260 onto attachment surface 180 at central portion 264 of seal 260 may be achieved. It will be appreciated that a similar procedure using assembly line fixtures may be performed on seal 160 and that a similar notch may be used on seal 160.

Figure 9A:
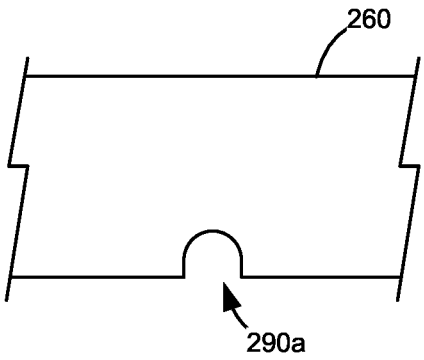
FIGS. 9A-9C are front elevation views illustrating central portions of seals each having a notch of a different shape according to multiple example embodiments.
Figure 9B:
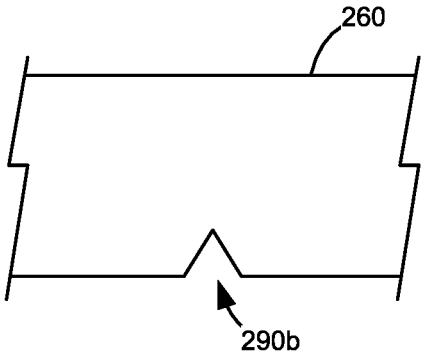
Figure 9C:
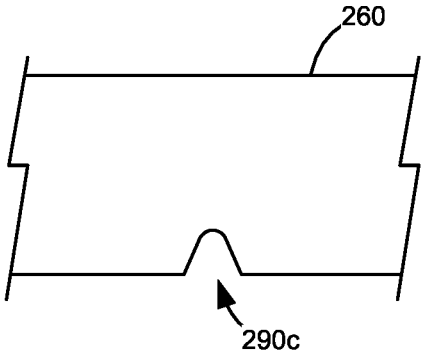

Notch 290 along edge 265 may have other forms and/or shapes and is not limited to the example shown in FIGS. 7 and 8. For example, FIGS. 9A-9C illustrate other shapes of notch 290. In FIG. 9A, a notch 290*a* is shown having a half obround shape. In FIG. 913, a notch 290*b* is shown having a triangular shape. In FIG. 9C, a notch 290*c* is shown having a parabolic shape. Other shapes may be used as desired.

The unassembled state, shape and/or profile of seal 160, 260 is not limited to the example embodiments illustrated above. Other shapes, forms, or profiles of seal 160, 260 are possible. For example, free edge 167, 267 of seal 160, 260 may follow a non-linear profile that varies along longitudinal dimension 170. Further, one or both of edge 165, 265 and free edge 167, 267 of seal 160, 260 may have a profile that varies along longitudinal dimension 170 as desired.

Although the example embodiments discussed above have been described in the context of a sealing assembly disposed against a developer roll of a toner cartridge, it will be appreciated that such a sealing assembly may be applied to other components in a toner cartridge and/or other assemblies of an image forming device, such as, for example, to cleaner blade 136 and/or to an intermediate transfer member of the image forming device.

Further, although the example embodiment discussed above includes a single replaceable unit in the form of toner cartridge 100 for each toner color, it will be appreciated that the replaceable unit(s) of the image forming device may employ any suitable configuration as desired. For example, in one embodiment, the main toner supply for the image forming device is provided in a first replaceable unit and the developer unit and photoconductor unit are provided in a second replaceable unit. In another embodiment, the main toner supply for the image forming device and the developer unit are provided in a first replaceable unit and the photoconductor unit is provided in a second replaceable unit. Other configurations may be used as desired.

Further, it will be appreciated that the architecture and shape of toner cartridge 100 illustrated in FIG. 2 is merely intended to serve as an example. Those skilled in the art understand that toner cartridges, and other toner containers, may take many different shapes and configurations.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A sealing assembly for use in an electrophotographic image forming device, comprising:

a housing;

an imaging component positioned on the housing; and a seal having opposed first and second edges extending along a longitudinal dimension of the seal, a lateral dimension of the seal is perpendicular to the longitudinal dimension and extends in a direction from the first edge to the second edge, the seal is attached to the housing along the first edge and contacts the imaging component along the second edge, wherein upon attachment to the housing the seal is elastically deformed from an unassembled state in which the second edge has a first profile that varies in the lateral dimension along the longitudinal dimension to an assembled state in which the second edge is deformed relative to the first profile to a second profile having less variation in the lateral dimension along the longitudinal dimension than the first profile.

2. The sealing assembly of claim 1, wherein in the unassembled state of the seal the second edge of the seal tapers toward the first edge from first and second end portions of the second edge toward a central portion of the second edge.

3. The sealing assembly of claim 2, wherein in the unassembled state of the seal the second edge of the seal tapers linearly toward the first edge from the first and second end portions of the second edge toward the central portion of the second edge.

4. The sealing assembly of claim 2, wherein in the unassembled state of the seal the second edge of the seal curves toward the first edge from the first and second end portions of the second edge toward the central portion of the second edge.

5. The sealing assembly of claim 1, wherein in the assembled state of the seal the second edge of the seal extends uniformly in the lateral dimension along the longitudinal dimension.

6. The sealing assembly of claim 1, wherein in the unassembled state of the seal the first edge of the seal extends uniformly in the lateral dimension along the longitudinal dimension.

7. The sealing assembly of claim 1, wherein in the unassembled state of the seal the first edge of the seal varies in the lateral dimension along the longitudinal dimension.

8. The sealing assembly of claim 1, wherein the first edge of the seal includes a notch formed at a middle section of the first edge for receiving a reference datum during assembly of the seal onto the housing.

* * * * *